United States Patent [19]

Schaffer

[11] 4,183,237

[45] Jan. 15, 1980

[54] METHOD OF MAKING ALUMINUM CANS

[75] Inventor: Dennis A. Schaffer, Hendersonville, Tenn.

[73] Assignee: Carmet Company, Pittsburgh, Pa.

[21] Appl. No.: 899,603

[22] Filed: Apr. 24, 1978

Related U.S. Application Data

[62] Division of Ser. No. 827,908, Aug. 26, 1977, Pat. No. 4,109,502.

[51] Int. Cl.[2] ..... B21D 22/00

[52] U.S. Cl. ..... 72/349; 72/468; 113/120 H

[58] Field of Search ..... 72/347–349, 72/467, 344, 468; 113/120 H; 76/DIG. 11

[56] References Cited

U.S. PATENT DOCUMENTS

| | | | |
|---|---|---|---|
| 166,568 | 8/1875 | Thomas | 72/468 X |
| 1,742,795 | 7/1930 | Tanner | 72/349 X |
| 3,359,775 | 12/1967 | Langewis | 72/344 |
| 3,653,249 | 4/1972 | Dunn | 72/349 |
| 3,735,629 | 5/1973 | Paramonoff | 113/120 H UX |
| 3,943,740 | 3/1976 | Bartenstein | 72/349 |

OTHER PUBLICATIONS

"Carboloy," copyright 1946.

*Primary Examiner*—Leon Gilden
*Attorney, Agent, or Firm*—Vincent G. Gioia

[57] ABSTRACT

A container for drawing or ironing dies is particularly useful but is not limited to can making. It includes an outer ring having an inwardly extending flange at one end and a disc secured to its other end so as to provide a peripheral space for receiving at least three segments which are resiliently urged against a die ring. The radial length of the slot is greater than the radial length of the segments so that the die ring can be displaced from the normal axis of the die pack. Means co-axial with the normal axis of the die limit inward movement of the segments.

1 Claim, 5 Drawing Figures

METHOD OF MAKING ALUMINUM CANS

This is a division of application Ser. No. 827,908, filed Aug. 26, 1977 now U.S. Pat. No. 4,109,502 issued 8/29/78.

This invention relates to a method of making aluminum cans. From approximately 140 to 270 cans per minute may be made in apparatus similar to that shown in Paramonoff U.S. Pat. No. 3,735,629 dated May 19, 1973. The average can wall thickness may vary and the eccentricity or thickness at different peripheral positions may also vary, both of which require more material to be used than would otherwise be necessary. By using floating dies with positive centering these disadvantages are overcome to a great extent. While floating dies have been in successful use for more than 10 years, those of which I have knowledge have various disadvantages. The reason for using floating dies is to permit the die to move transversely when its axis does not coincide with the axis of the workpiece, but it is important that the die return accurately to its original position after it has been moved transversely by a workpiece to solve the problems set forth above. Floating dies most generally used as shown in the above mentioned Paramonoff patent does not provide for such return.

It is therefore an object of my invention to provide a method of making metal cans which results in a substantial savings in metal used.

This and other objects will be more apparent after referring to the following specification and attached drawings: in which FIG. 1 is a sectional view of the apparatus of my invention;

Figure 1:
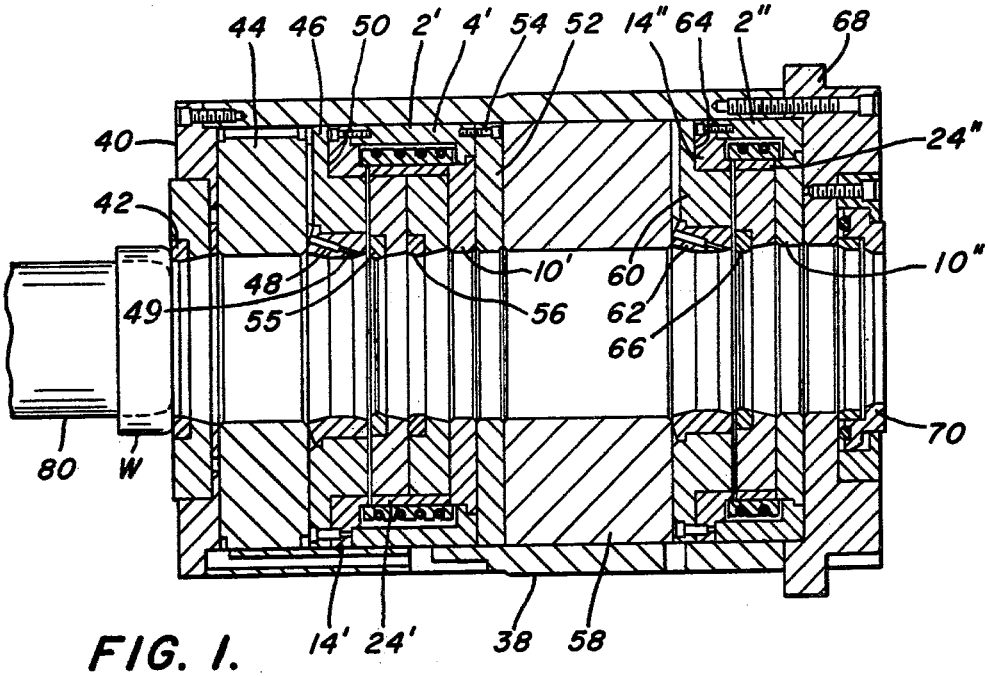
Figure 2:
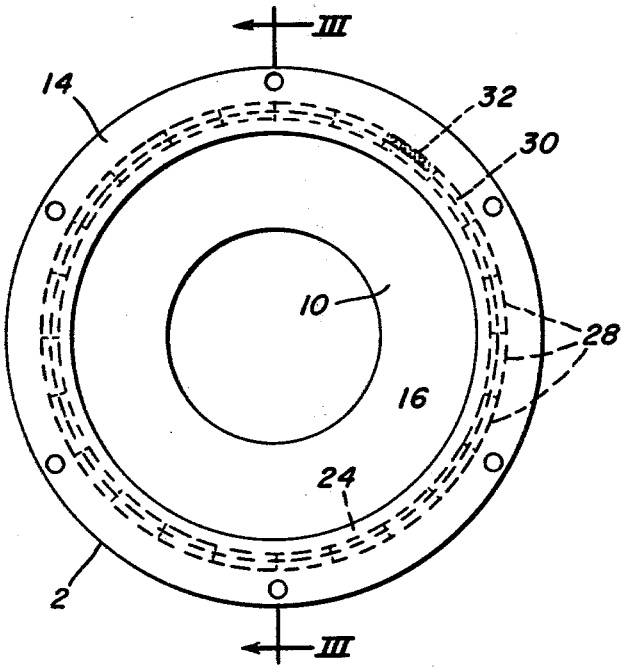
FIG. 2 is an elevation of a die container of my invention.
Figure 3:
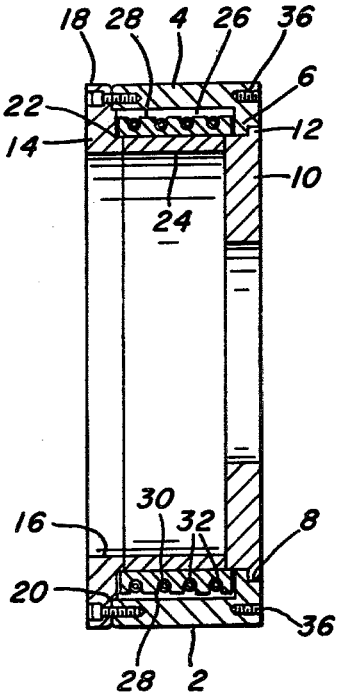
FIG. 3 is a view taken on the III—III of FIG. 2.
Figure 4:
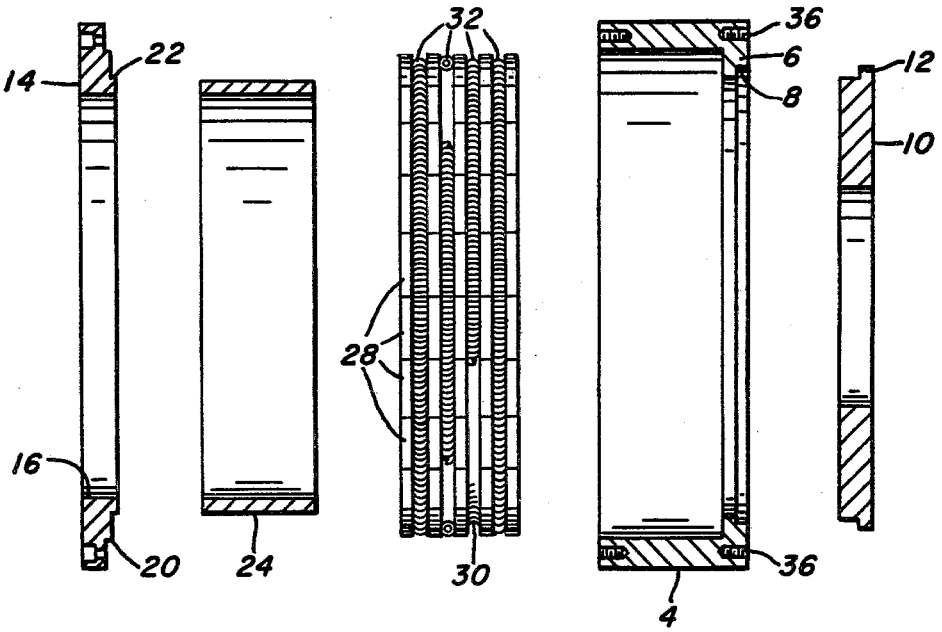
FIG. 4 is an exploded view of the container of FIG. 3.
Figure 5:
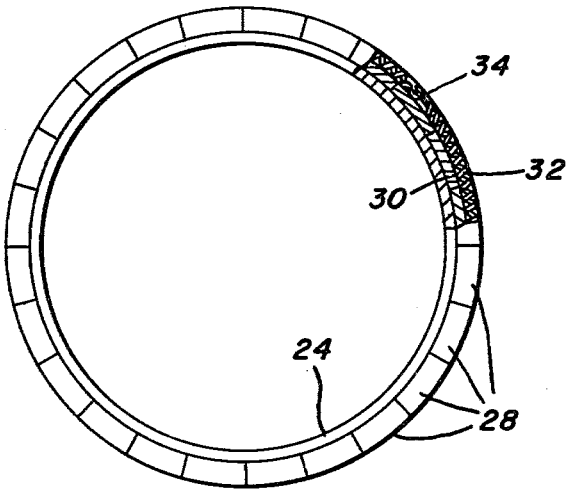
FIG. 5 is an end view, partly in section, of the die ring and segmental support of FIG. 3.

Referring more particularly to the drawings, reference numeral 2 indicates the die container of my invention. The die container 2 includes an outer steel ring 4 having an inwardly extending radial flange 6 with a peripheral groove 8 therein. A tungsten carbide wear plate or disc 10 having an outwardly extending radial flange 12 is received in one end of the ring 4 with its flange 12 in groove 8. A steel disc or cap 14 is secured to the other end of ring 4 by means of cap screws. The disc 14 has an axial hole 16 therein, an outer peripheral surface 18, an intermediate peripheral surface or shoulder 20 and an inner peripheral surface or shoulder 22 so that the disc has a minimum thickness outer portion, an intermediate thickness intermediate portion, and a maximum thickness inner portion. A floating die retaining ring 24 is received between the discs 10 and 14 and has an inner diameter smaller than the diameter of hole 16. Thus there is a space 26 between the outer ring 4 and inner ring 24 extending from the inner side of flange 6 to the intermediate portion of disc 14. The die ring may be integral with the die, but it is preferred to have it separate. At least three segments 28 are received in the opening 26 with their inner diameter being approximately the same as the outer diameter of ring 24. The segments 28 may vary in number depending upon size and other conditions, but is preferred that their total inner surfaces be approximately equal to the outer circumference of the ring 24. The greater the number of segments, up to a reasonable number, the more precise will be the operation. The radial thickness of the segments 28 must be less than the radial width of opening 26. The segments 28 have a plurality of spaced apart outer peripheral grooves 30 therein with the grooves in each segment being aligned with corresponding grooves in the other segments. A garter spring 32 is received in each set of alligned grooves. The tension of each spring may be adjusted by a connection 34. A plurality of tapped holes 36 may be provided in outer ring 4 at the end having flange 6 for a purpose which will appear later.

My die container may be used with various types of dies such as those shown in the above identified Paramonoff patent. However, it has been successfully used in the assembly shown in FIG. 1. As there shown reference numeral 38 indicates a tubular housing having a retainer 40 at its entry end which supports a redraw die 42. A spacer 44 abuts the retainer 40. A lube distributor body 46 carrying a lube insert 48, preferably made of brass abuts the spacer 46. Lubrication is provided through conduit 49. The body 46 has a cut-out portion 50 for receiving cap 14' of double die pack 2'. A plate 52 abuts wear plate 10' and is secured to outer ring 4' by means of cap screws 54 threaded into holes 36. Front ironing die 54 and edge control die 56 are supported within die ring 24'. A spacer 58 extends between plate 52 and lube distributor body 60 having a lube insert 62 and a cut-out portion 64 for receiving cap 14'' of container 2''. An end ironing die 66 is received in die ring 24''. An end plate 68 attached to housing 38 bearing against wear plate 10 and supports stripper 70 similar to that shown in the Paramonoff patent or Huchison U.S. Pat. No. 3,735,628, dated May 29, 1973. However, because of the positive centering action of the dies the stripper need not be adjustable, thus reducing its cost.

In operation, the workpiece W in the form of a metal cup is drawn into the left end of the assembly of FIG. 1 by means of punch 80, preferably made of tungsten carbide, and the drawing takes place in a manner similar to that of the Paramonoff patent with the can being moved completely through the assembly and being stripped from the punch 80 as it is retracted. As the workpiece passes through dies 54, 56 and 66 they are free to move laterally from their normal axes. This lateral movement causes part of the segments 28 to move outwardly so as to stretch the springs 32. When the workpiece is removed the springs 32 cause the segments 28 to move rapidly back to their original position. I have found that friction is reduced by making the wear plates 10 of carbide, particularly tungsten carbide, thus improving ease of movement of the dies. Because of the precise centering of the dies and, particularly when using a tungsten carbide punch, uniform and consistent wall thicknesses are obtained, thus permitting closer wall thickness tolerances with a reduction in the amount of metal used in the finished can. Thus, the size of the workpiece may be decreased or more scrap will be recovered if the same size workpiece is used. This is particularly important when using relatively expensive metal, such as aluminum. Because of the great number of cans formed, even a small reduction in metal per can results in substantial savings.

While one embodiment has been shown and described in detail, it will be readily apparent to those skilled in the art that various adaptations and modifications may be made within the scope of the invention.

I claim:

1. The method of making aluminum cans or the like which comprises:

A. providing a die assembly having a plurality of carbide dies arranged in axial alignment, at least some of said dies being mounted in a floating ring surrounded by at least three segments mounted in a peripheral space, and a carbide disc bearing against the exit side of said die that is mounted in the floating ring;

B. pushing a can blank on a carbide punch through said dies to form a can;

C. removing said can from the dies; and

D. after removing said can from the dies, centering the dies mounted in the floating ring by resiliently urging the segments surrounding said floating ring inwardly toward stop means concentric with the normal axis of the dies.

* * * * *